United States Patent [19]

Gasper

[11] 4,352,516

[45] Oct. 5, 1982

[54] SPREADER BAR

[75] Inventor: John S. Gasper, Fort Wayne, Ind.

[73] Assignee: North American Van Lines, Inc., Fort Wayne, Ind.

[21] Appl. No.: 158,247

[22] Filed: Jun. 10, 1980

[51] Int. Cl.[3] ..... B66C 1/10

[52] U.S. Cl. ..... 294/81 R; 294/67 DA

[58] Field of Search ..... 294/63 R, 67 R, 67 AA, 294/67 B, 67 D, 67 DA, 78 A, 81 R, 81 SF

[56] References Cited

U.S. PATENT DOCUMENTS

| | | | |
|---|---|---|---|
| 1,261,155 | 4/1918 | Norris | 294/67 DA X |
| 2,142,416 | 1/1939 | Russell | 294/81 R |
| 2,557,253 | 6/1951 | Belden | 294/63 R X |
| 3,083,840 | 4/1963 | Gibbs | 294/67 D X |
| 3,304,115 | 2/1967 | Brooks et al. | 294/81 R |
| 3,561,810 | 2/1971 | Newsted | 294/81 R |

FOREIGN PATENT DOCUMENTS

| | | | |
|---|---|---|---|
| 1058551 | 3/1954 | France | 294/81 R |
| 1439248 | 4/1966 | France | 294/81 R |

*Primary Examiner*—Johnny D. Cherry

*Attorney, Agent, or Firm*—Scully, Scott, Murphy & Presser

[57] ABSTRACT

A spreader bar arrangement adapted to be attached to an elongated product, such as a telephone switchgear frame, which assists in loading and unloading the product onto a transport vehicle having a movable crane mechanism. The spreader bar arrangement includes a support member extending along the top of the elongated product and having a plurality of fastening apertures therein which coincide with coupling points in the upper frame of the product such that the support member may be bolted thereto. A connector member is attached to the support member centrally along its length and includes at least one U-bolt extending around the support member. A bracket is bolted to the legs of the U-bolt, and a pin extends centrally through the bracket and has a hole therein for attachment to the crane mechanism of a transport vehicle.

1 Claim, 10 Drawing Figures

SPREADER BAR

BACKGROUND OF THE INVENTION

Field of the Invention

The present invention relates generally to equipment for assisting in the transportation of goods on a transport vehicle, and more particularly pertains to an arrangement which enables a product to be lifted and transported by a movable crane mechanism on a transport vehicle.

Certain types of elongated products, such as telephone switchgear frames, present considerable problems in the transportation thereof. These types of products are rather bulky and cumbersome in nature, and are not susceptible of being packaged in an outer protective shipping container.

In the prior art, switchgear frames of the type discussed herein have been loaded onto a transport vehicle such as a trailer by a form of two-wheeled dolly known commercially as a ROL-A-LIFT. The dollies are positioned under the switchgear frame, and the frames are then manually pulled or pushed up a loading ramp or walkboard to the floor of the transport vehicle. A transportation arrangement of this nature suffers from several disadvantages, not the least of which is the extensive manual effort required to roll the switchgear frames up the ramp onto the transport vehicle.

Another arrangement utilized in the prior art for the handling of switchgear frames in transportation involves the use of a crane trailer. A crane trailer is a standard type of transport trailer equipped with a movable crane mechanism which travels along the length of the vehicle on a track mounted on the ceiling thereof. When the rear doors of the trailer are opened, the crane track can be extended past the end of the trailer to facilitate the loading and unloading of goods. These vehicles were used to transport telephone switchgear frames in arrangements in which chains and straps connected the switchgear frame to the crane mechanism for loading and unloading thereof. The crane mechanism is then utilized to hoist the switchgear frame to the floor level of the trailer, and the frame was then manually pushed or pulled on dollies into the trailer. While a loading arrangement of this nature is more efficient and requires less manual labor then that discussed in the previous paragraph, it frequently resulted in both cosmetic and stretch damage to the switchgear frames caused by the stresses applied thereto during the loading and unloading operation.

SUMMARY OF THE INVENTION

Accordingly the present invention contemplates the provision of an improved arrangement for transporting an elongated, relatively bulky and heavy product such as a switchgear frame in a manner which is both more efficient and less cumbersome than the aforementioned systems of the prior art.

Another object of the present invention is to provide a transportation arrangement for an elongated bulky and heavy product such as a switchgear frame which does not result in either cosmetic or stretch damage to the product.

A more detailed object of the present invention is the provision of a transportation arrangement for an elongated, bulky and heavy product such as a telephone switchgear frame which allows the product to be easily lifted onto and off a transport vehicle by a movable crane mechanism thereon. The transportation arrangement includes a support member extending along the top of the elongated product and having a plurality of fastening apertures spaced along its length in coincidence with similar fastening points in the upper frame of the product to enable the support member to be bolted thereto. A connector means is centrally disposed along the length of the support member to couple it to the movable crane mechanism to enable the product to be lifted onto and off the transport vehicle with a minimum amount of damage to the product. Furthermore in accordance with several preferred embodiments of the present invention, the support member is a channel shaped member, and the connector means is movable along the length of the support member to enable it to be centered relative to the weight of the supported product. In one embodiment the connector includes a U-bolt extending around the support member and a bracket having several holes therein for receipt of the legs of the U-bolt. This arrangement enables the U-bolt and bracket to be moved along the length of the support member to center it relative to the weight of the elongated product. The U-bolt and bracket are then bolted in place relative thereto. A connector pin is centrally disposed through the bracket and has a radially extending bore through its body to enable the connector to be fastened to the movable crane mechanism. In another embodiment of the present invention, the connector includes two U-bolts extending around a channel shaped support member, and the bracket has four matching holes therein such that the two U-bolts and bracket may be tightened around the channel shaped support member at a central location along its length.

Accordingly it is a primary object of the present invention to provide a transportation arrangement for an elongated, bulky and relatively heavy product such as a telephone switchgear frame which enables the frame to be loaded onto a transport vehicle with a movable crane mechanism thereon, and which results in a minimum amount of cosmetic and stretch damage to the frame during loading and unloading thereof.

BRIEF DESCRIPTION OF THE DRAWINGS

The foregoing and other objects and advantages of the inventive transportation arrangement of the present invention may be more readily ascertained by one skilled in the art, having reference to the following detailed description of several preferred embodiments thereof, taken in conjunction with the accompanying drawings wherein identical reference numerals are utilized to refer to like elements throughout the several views, and in which.

DETAILED DESCRIPTION

Figure 1:
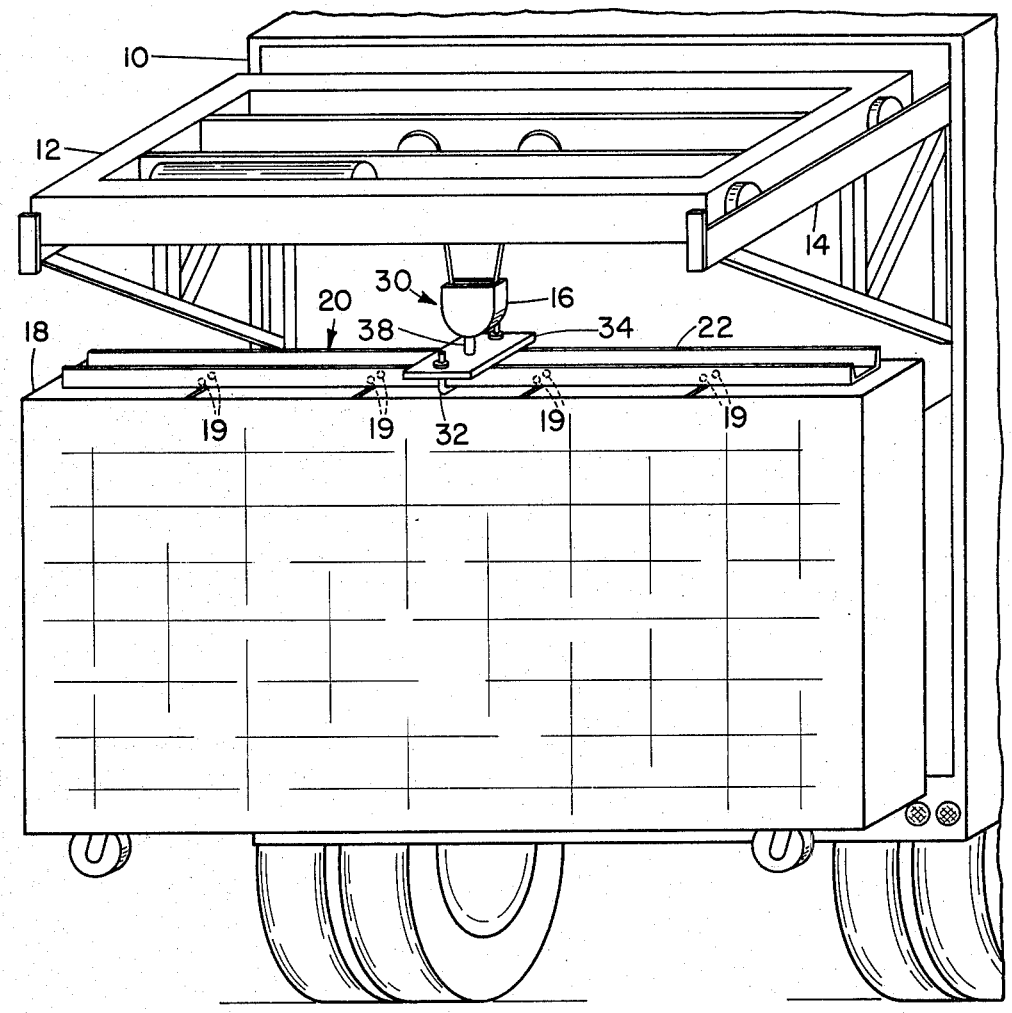
FIG. 1 is an illustration of the spreader bar of the present invention being utilized to load a telephone switchgear frame onto a transport vehicle by the use of a crane mechanism extending from the cargo bay thereof.

Referring now in detail to the drawings, FIG. 1 illustrates a perspective view of the rear portion of a transport vehicle in the nature of a trailer 10 having a movable crane mechanism 12 supported therefrom by a crane track 14 which extends past the end of the trailer to facilitate the loading and unloading of goods. The crane 12 is shown supporting a block and tackle hoisting arrangement 16 which is coupled to an elongated bulky product in the form of a telephone switchgear frame 18 having a plurality of apertures 19 in the top thereof useful for fastening as described herein. The spreader bar arrangement 20 forming the subject of the present invention is interposed between the top frame of the telephone switchgear and the hoisting mechanism 16 mounted to the rear of the truck, and serves to distribute the weight of the switchgear substantially evenly along the length of its top frame member.

The spreader bar arrangement 20 is illustrated in greater detail in FIGS. 2 through 7 and includes a channel shaped support member 22 formed with a length approximately the length of a telephone switchgear frame 18 to which it is adapted to be attached. The top of the switchboard frame includes a number of attachment apertures 19 therein, and the channel shaped support member 22 includes a plurality of slots 24 formed generally in alignment with the fastening apertures in the upper frame of the telephone switchgear equipment. Fastener bolts 26, each having a T-shaped head, may be utilized to secure the support member 22 to the upper switchgear frame 18 through the slots 24. The bolts include T-shaped heads 28, which enable the bolt heads to be inserted through the slots 24 into attachment apertures in the upper frame 18 and then twisted 90° therein into a position in which nuts threadedly engaged on the bolts may be tightened to secure the support member 22 to the upper frame 18.

Figure 4:
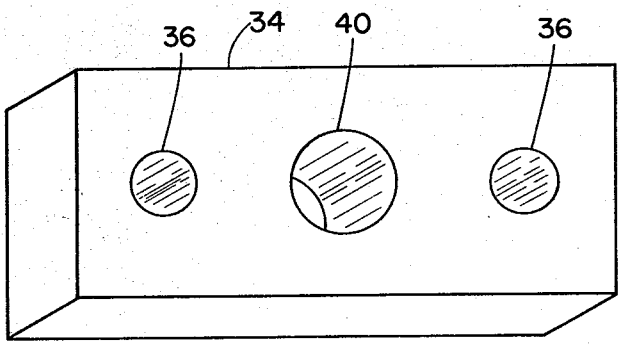
FIG. 4 is a perspective view of a bracket forming a second part of the connector mechanism.
Figure 3:
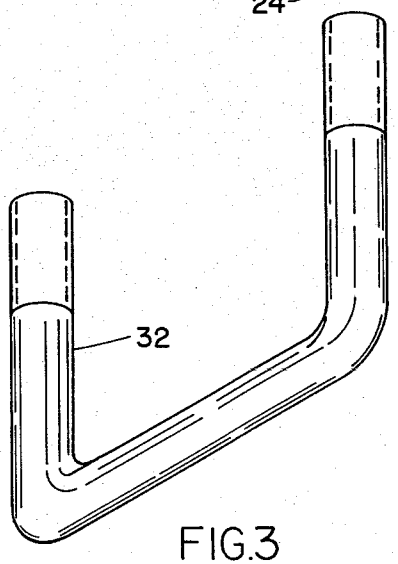
FIG. 3 is a perspective view of a U-bolt which forms a part of a connector mechanism for connecting the support member of FIG. 2 to the crane mechanism of a transport vehicle.
Figure 7:
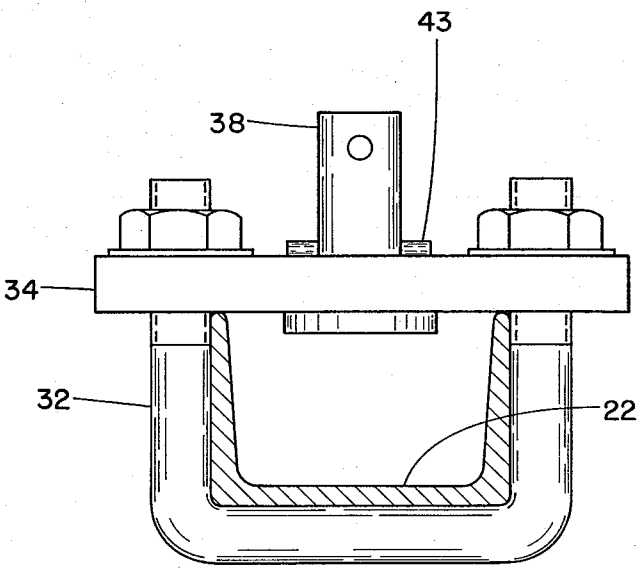
FIG. 7 is a sectional view through the support bar, illustrating the connector mechanism secured thereto.
Figure 6:
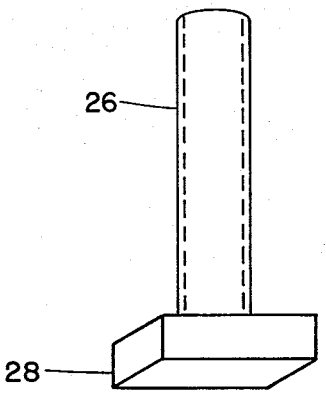
FIG. 6 is a perspective view of a special bolt useful in attaching the channel member of FIG. 2 to the elongated product.
Figure 5:
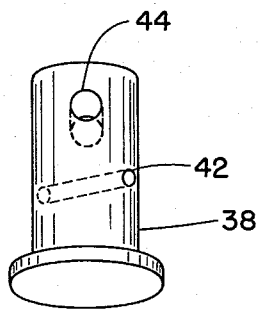
FIG. 5 is a perspective view of a connector pin adapted to extend through the central aperture of the bracket of FIG. 4, with the pin providing a connection to the movable crane mechanism of a transport vehicle.

A connector mechanism 30 is utilized to couple the support member 22 to the hoisting mechanism 16, and includes the components shown in FIGS. 3, 4 and 5. The connector mechanism includes a U-bolt 32 extending from the bottom of the support member 22 therearound with the legs of the bolt extending parallel to the legs of the channel shaped support member 22. A connector bracket 34 has a pair of holes 36 spaced to match the legs of the U-bolt, and the bracket 34 is laid over the top of the support member 22 onto the legs of the bolt. The bracket 34 and U-bolt 32 are then tightened around the member 22 by nuts threadedly engaged onto the legs of the bolt. A connector pin 38 extends through a central aperture 40 in the bracket 34 and has a first radially directed bore 42 extending therethrough. A cotter pin 43 is inserted through bore 42 to hold the connector pin in the bracket between the pin head and the cotter pin. A second radially directed bore 44 is formed in a portion of the connector pin shaft extending above the bracket 34, and is adapted to receive a hook or similar coupling from the hoisting mechanism 16.

Figure 2:
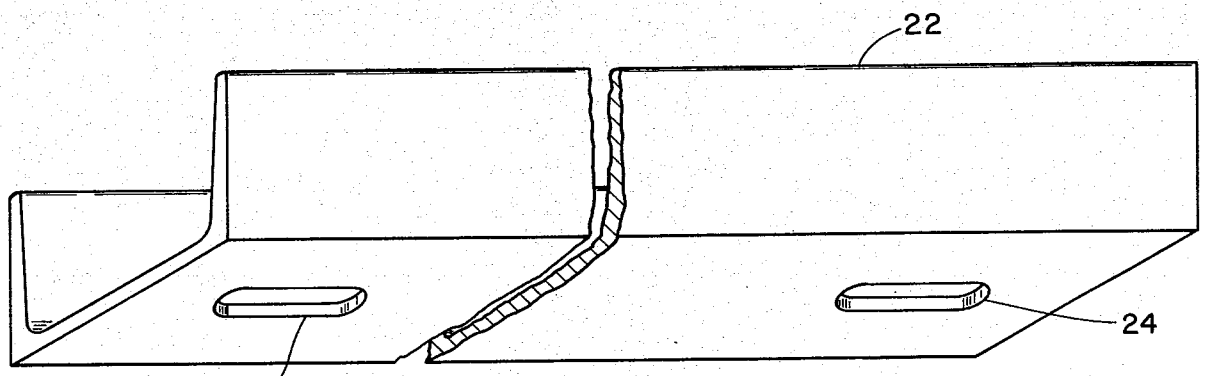
FIG. 2 is a perspective view of a channel shaped support member utilized in a first embodiment of the present invention.
Figure 8:
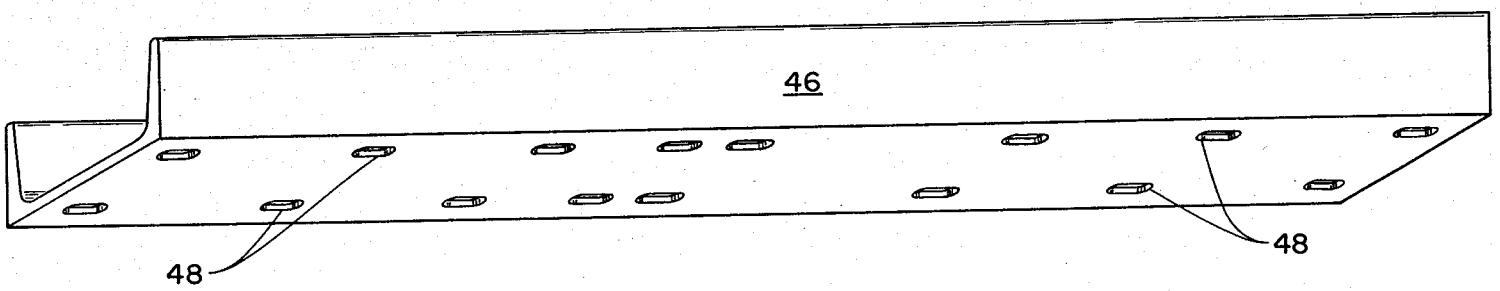
FIG. 8 is a perspective view of a second embodiment of a support member.
Figure 9:
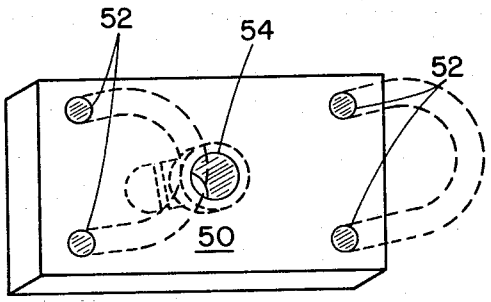
FIG. 9 is a perspective view of a bracket forming a part of a second embodiment of the connector mechanism.

FIG. 8 illustrates a second embodiment of a channel shaped support member 46, similar in concept to the embodiment illustrated in FIG. 2, but having more slots 48 cut in the top thereof to facilitate the attachment of the support member to a longer telephone switchgear frame than the first embodiment is capable of supporting. In view of the length of the support member 46, a slightly modified connector bracket 50, as shown in FIG. 9, is utilized wherein two U-bolts, shown in phantom, are adapted to be placed under the support member, also illustrated in phantom with the legs thereof extending through a pair of spaced holes 52 formed in the bracket. In a manner similar to the first embodiment, a centrally formed hole 54 in the connector bracket is utilized to receive a connector pin 38.

Figure 10:
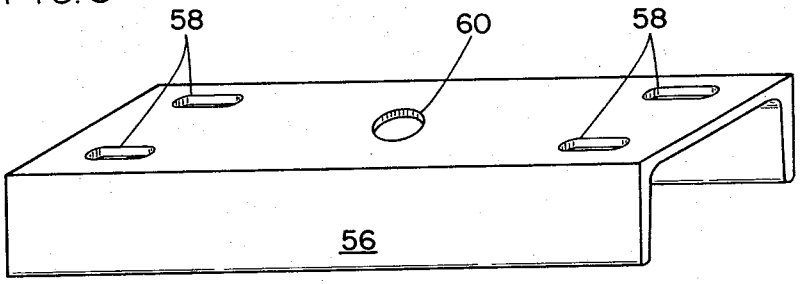
FIG. 10 is a perspective view of a third embodiment of a support member formed by a relatively short, channel shaped member.

FIG. 10 illustrates a relatively short embodiment of a spreader bar arrangement 56 for relatively short products, and accordingly this support member only has four slots 58 formed therein. Because of the relatively short length of this support bar, the more complex connector mechanisms illustrated in the first and second embodiments are not utilized herein, in favor of a centrally positioned aperture 60 in the support member which is adapted to directly receive a connector pin 38 therethrough, in a manner similar to the connection of the connector pins to the brackets in the first and second embodiments. In this particular embodiment, the channel shaped support member 56 is adapted to be placed on the switchgear frame with the legs of the channel member extending downwardly, in a manner opposite the embodiments of FIGS. 2 and 8.

In the construction of the spreader bar arrangements of the present invention, the channel shaped U-members may be formed from commercially available steel or aluminum channel stock, machined for the various connecting apertures therein. The U-bolts may be commercially available off-the-shelf items. The connector pin and the connector bracket may also be formed of suitable steel or aluminum stock material.

While the present invention has been illustrated and explained with respect to an elongated product in the form of a telephone switchgear frame, it should be apparent that the teachings of the present invention are directly applicable to other similarly bulky and heavy products which have to be moved via transport vehicles.

From the foregoing, it should be apparent that the objects of the present invention have been fully achieved herein, and that as a result of the disclosed invention, a new type of spreader bar arrangement has been provided. Although several preferred embodiments illustrating the principles of the present invention have been described, in detail herein, it should be realized that the same are not limited to the particular configurations illustrated in the drawings, and that many modifications thereof are contemplated and may be made without departing from the broad spirit and scope of this invention as defined in the appended claims.

What is claimed is:

1. A spreader bar arrangement for enabling an elongated product, comprising an elongated telephone switchgear frame having an upper frame, to be lifted and transported by a transport vehicle having a movable crane mechanism thereon, comprising:

a. a channel shaped support member extending along the top of the elongated telephone switchgear frame, said channel shaped support member having a plurality of fastening apertures therein spaced along its length in coincidence with similar fastening apertures in the upper frame of the elongated telephone switchgear frame;

b. fastener means fastening said channel shaped support member to the elongated telephone switchgear frame at said plurality of fastening apertures; and c. a connector means centrally disposed along the length of said channel shaped support member for coupling said support member, and the elongated telephone switchgear frame support thereby, to the crane mechanism on the transport vehicle, whereby the channel shaped support member enables the elongated telephone switchgear frame to be lifted upon and transported by the transport vehicle with a minimum amount of damage to the switchgear frame, said connector means including two U-bolts extending around said channel shaped support member with the closed end of each U-bolt mounted around the bottom of said support member, and a bracket, having four holes therein for receipt of the legs of the two U-bolts, being fastened to the legs of the two U-bolts above said support member, whereby the two U-bolts may be loosened relative to the bracket to enable the connector means to be centered relative to the weight of the elongated product to provide a balanced load for the crane mechanism, and said bracket having a centrally mounted attachment means including a centrally located pin extending therethrough for attachment to the crane mechanism of a transport vehicle.

* * * * *